US007290847B2

(12) United States Patent
Shirotori et al.

(10) Patent No.: US 7,290,847 B2
(45) Date of Patent: Nov. 6, 2007

(54) IC CHIP, PRINT APPARATUS, AND HEAT GENERATION WARNING METHOD

(75) Inventors: Hiroshi Shirotori, Nagano (JP); Masahiko Moriyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 982 days.

(21) Appl. No.: 10/300,909

(22) Filed: Nov. 21, 2002

(65) Prior Publication Data

US 2003/0142346 A1 Jul. 31, 2003

(30) Foreign Application Priority Data

Nov. 22, 2001 (JP) ..... P2001-357627
Apr. 5, 2002 (JP) ..... P2002-104453

(51) Int. Cl.
*B41J 29/38* (2006.01)

(52) U.S. Cl. ..... 347/17; 347/19; 347/5

(58) Field of Classification Search ..... 347/11, 347/17, 19, 5, 10; 400/54; 358/1.15
See application file for complete search history.

(56) References Cited

U.S. PATENT DOCUMENTS 4,705,412 A * 11/1987 Matsumoto ..... 400/54
6,109,716 A * 8/2000 Takahashi ..... 347/11

FOREIGN PATENT DOCUMENTS

| | | | |
|---|---|---|---|
| EP | 0587352 A | * | 3/1994 |
| JP | 6-225582 | | 8/1994 |
| JP | 8-501199 | | 2/1998 |

* cited by examiner

*Primary Examiner*—Lam Son Nguyen
(74) *Attorney, Agent, or Firm*—Sughrue Mion, PLLC

(57) ABSTRACT

A printer (1) comprises a motor driver (34) for driving a carriage motor (20) and a paper feed motor (22). The motor driver (34) has a thermal shutdown circuit (43). If internal temperature T of the motor driver exceeds threshold value Ta, the thermal shutdown circuit shuts down the power of the motor driver. The motor driver has an internal temperature detection circuit (45). If the internal temperature T exceeds threshold value Tb (<Ta) before thermal shutdown processing operates, the internal temperature detection circuit outputs a HW signal. A CPU (29) executes heat generation stop processing based on the HW signal and controls the motor driver to stop the carriage motor and the paper feed motor for a predetermined time.

14 Claims, 4 Drawing Sheets

IC CHIP, PRINT APPARATUS, AND HEAT GENERATION WARNING METHOD

BACKGROUND OF THE INVENTION

This invention relates to an IC chip, a print apparatus, and a heat generation warning method.

A printer in a related art contains a motor driver for outputting a motor signal responsive to a control signal from a CPU to drive a carriage motor and a paper feed motor. The motor driver is implemented as a one-chip IC and a power supply voltage is supplied to one of a plurality of pins extending from a package. The motor driver is mounted on a board together with the CPU, memory, and a logic circuit.

This kind of motor driver has a thermal shutdown function to protect from heat generation. JP-A-6-225582, JP-A-8-501199, etc., discloses an example of a thermal shutdown circuit. If a carriage motor or a paper feed motor is over used and the internal temperature of the motor driver exceeds a threshold value (junction temperature), the thermal shutdown circuit operates for shutting down output of the motor driver. Accordingly, the carriage motor and the paper feed motor are stopped independently of the drive situation, and print processing and paper feed operation are forcibly terminated, thereby protecting the motor driver from heat generation.

However, in the protection method using the thermal shutdown function, the power of the motor driver is forcibly shut down at the shutdown time and thus the carriage motor and the paper feed motor are stopped independently of the print processing. Therefore, if the motor driver is cooled and is recovered from heat generation, it is impossible to resume the print processing at the shutdown point in time, and the print processing needs to be again performed from the beginning.

On the other hand, there is demand for reducing the cost of the motor driver. To meet the demand, the chip area may be lessened. However, if the chip area is lessened, the motor driver easily generates heat accordingly and the shutdown frequency is increased. If the shutdown frequency is thus increased, the print processing is forcibly terminated each time a shutdown occurs, interfering with smooth print processing. Thus, there is also a problem of incapability of lessening the chip area.

SUMMARY OF THE INVENTION

It is therefore an object of the invention to provide an IC chip, a print apparatus, and a heat generation warning method for making it possible to protect a driver circuit from heat generation and continuously execute predetermined processing operation if the driver circuit is protected from heat generation.

To the end, according to a first aspect of the invention, there is provided an IC chip for outputting a drive signal responsive to an external control signal for a driving drive unit, where in when the internal temperature of circuitry exceeds a first threshold value, output of the drive signal is shut down, the IC chip comprising a temperature detection unit for detecting the internal temperature of the circuitry of the IC chip; and a signal output unit for outputting a signal to stop the drive unit if the temperature detected by the temperature detection unit exceeds a second threshold value set to a lower temperature than the first threshold value.

According to the invention, the internal temperature of the circuitry of the IC chip is detected by the temperature detection unit and when the internal temperature exceeds the second threshold value, the signal output unit outputs a signal to stop the drive unit. Therefore, if the IC chip generates heat, the drive unit is once stopped before the internal temperature of the IC chip exceeds the first threshold value and output of the drive unit is shut down, so that the IC chip is protected from heat generation without using a method of shutting down output of the drive unit. Since the cooling method is a method of once stopping the drive unit, terminating each processing to execute cooling is avoided.

According to a second aspect of the invention, there is provided a print apparatus comprising a drive unit and a driver circuit for outputting a drive signal for driving the drive unit, wherein when internal temperature of the driver circuit exceeds a first threshold value, output of the drive signal is shut down, the print apparatus comprising a temperature detection unit for detecting the internal temperature of the driver circuit; and a control unit for controlling the driver circuit to stop the drive unit based on determination information as to whether or not the temperature detected by the temperature detection unit exceeds a second threshold value set to a lower temperature than the first threshold value.

According to the invention, the internal temperature of the driver circuit is detected by the temperature detection unit. The control unit performs processing based on the determination information as to whether or not the temperature detected by the temperature detection unit exceeds the second threshold value; for example, if the detected temperature exceeds the second threshold value, the control unit controls the driver circuit to stop the drive unit. Therefore, if the driver circuit generates heat, the driver circuit is controlled and the drive unit is stopped before the internal temperature of the driver circuit exceeds the first threshold value and output of the drive unit is shut down, so that the driver circuit is protected from heat generation without using a method of shutting down output of the drive unit.

According to a third aspect of the invention, in the second aspect, when the driver circuit is cooled as the drive unit is stopped and the detected temperature becomes equal to or less than the second threshold value, the control unit restarts driving the drive unit so as to continue processing at the stop point in time.

According to the third aspect of the invention, in addition to the function of the second aspect, when the driver circuit is cooled as the drive unit is stopped and the detected temperature becomes equal to or less than the second threshold value, the drive unit is restarted so as to continue the job at the point in time at which the stop state was entered, so that the processing interrupted as the drive unit was stopped can be continued.

According to a fourth aspect of the invention, in the second and third aspects, if the driver circuit is cooled as the drive unit is stopped and the detected temperature becomes equal to or less than the second threshold value, the control unit maintains the drive unit in the stop state for a predetermined time before restarting to drive the drive unit.

According to the fourth aspect of the invention, in addition to the function of the second third aspects of the invention, if the driver circuit is cooled and the detected temperature becomes equal to or less than the second threshold value, the drive unit is maintained in the stop state for the predetermined time, so that the cooling time of the driver circuit is prolonged and the driver circuit can be cooled sufficiently.

According to a fifth aspect of the invention, the print apparatus of the second to fourth aspects comprises a stop detection unit for determining whether or not the drive unit stops, wherein if the stop detection unit detects the drive unit stopping, the control unit determines whether or not the detected temperature exceeds the second threshold value.

According to the fifth aspect of the invention, in addition to the function of the second to fourth aspects of the invention, the stop detection unit determines whether or not the drive unit stops. If the stop detection unit detects the drive unit stopping, the control unit determines whether or not the detected temperature exceeds the second threshold value. Therefore, it is made possible to cool the driver circuit without interrupting the processing which needs to be continued using the drive unit as the drive source.

According to a sixth aspect of the invention, in the fifth aspect of the invention, the drive unit is a carriage motor for driving a carriage or a paper feed motor for moving paper, and when the carriage motor or the paper feed motor stops, the control unit determines whether or not the detected temperature exceeds the second threshold value.

According to the sixth aspect of the invention, in addition to the function of the fifth aspect of the invention, the stop detection unit determines whether or not the carriage motor or the paper feed motor stops. When the carriage motor or the paper feed motor stops, the control unit determines whether or not the detected temperature exceeds the second threshold value. If the detected temperature exceeds the second threshold value, the driver circuit is controlled and the drive unit is stopped. Accordingly, occurrence of print unevenness in the lateral direction of paper as the carriage motor is once stopped during the printing or occurrence of print unevenness in the longitudinal direction of paper as paper feed at a constant distance at a time is interrupted can be prevented.

According to a seventh aspect of the invention, in the second to sixth aspects of the invention, when the detected temperature exceeds the second threshold value, the control unit immediately controls the driver circuit to stop the drive unit.

According to the invention, in addition to the function of the second to sixth aspects of the invention, when the detected temperature exceeds the second threshold value, immediately the drive unit is stopped, so that when the driver circuit generates heat, immediately the driver circuit can be cooled.

According to an eighth aspect of the invention, the print apparatus of the second to seventh aspects comprises a notification unit, when the temperature detected by the temperature detection unit exceeds the second threshold value and the control unit stops the drive unit, for informing the user of the fact.

According to the eighth aspect of the invention, in addition to the function of the second to seventh aspects of the invention, when the detected temperature exceeds the second threshold value and the drive unit is stopped, the notification unit informs the user of the fact, so that it is made possible for the user to recognize that the processing is executed.

According to a ninth aspect of the invention, in the second to eighth aspects of the invention, the driver circuit is one IC chip comprising a temperature detection unit for detecting internal temperature of the IC chip, and a signal output unit for outputting a signal to stop the drive unit as determination information if the temperature detected by the temperature detection unit exceeds the second threshold value, and the control unit controls the driver circuit to stop the drive unit based on the signal output from the IC chip.

According to the ninth aspect of the invention, in addition to the function of the second to eighth aspects of the invention, the internal temperature of the IC chip is detected by the temperature detection unit and if the internal temperature exceeds the second threshold value, as the determination information, a signal to stop the drive unit is output from the signal output unit to the control unit. When inputting the signal, the control unit controls the IC chip to once stop the drive unit. By the way, if the area of the driver circuit (IC chip) is miniaturized, heat is easily generated and accordingly the internal temperature of the IC chip easily exceeds the first threshold value and output of the drive signal from the IC chip is shut down. However, before output of the drive signal is shut down, the IC chip is controlled to stop the drive unit, whereby the IC chip is cooled, so that shutting down of the drive signal output from the IC chip becomes hard to occur, and the substrate area can be miniaturized.

According to a tenth aspect of the invention, in the ninth aspect of the invention, the driver circuit comprises a regulator for supplying stable power to a predetermined circuit other than the driver circuit contained in the print apparatus.

According to the tenth aspect of the invention, in addition to the function of the ninth aspect of the invention, the driver circuit contains the regulator. By the way, if the driver circuit contains the regulator, when the internal temperature of the driver circuit exceeds the first threshold value and output of the drive signal from the driver circuit is shut down, output from the regulator is also shut down. However, before output of the drive signal is shut down, the driver circuit is controlled to stop the drive unit, whereby the driver circuit is cooled, so that shutting down of the drive signal output from the driver circuit becomes hard to occur, and the frequency of turning off the, power of the regulator can be lessened.

According to an eleventh aspect of the invention, in the ninth and tenth aspects of the invention, one driver circuit can drive a plurality of drive unit.

In this case, in addition to the function of the ninth aspect and tenth aspects of the invention, one driver circuit drives a plurality of drive unit.

According to a twelfth aspect of the invention, in the second to eleventh aspects of the invention, if the temperature detected by the temperature detection unit exceeds a third threshold value set to a lower temperature than the second threshold value, the control unit performs duty control of the driver circuit.

According to the twelfth aspect of the invention, in addition to the function of the second to eleventh aspect of the invention, the third threshold value is set as a lower temperature than the second threshold value and if the temperature detected by the temperature detection unit exceeds the third threshold value, duty control of the driver circuit is performed and heat generation of the driver circuit is suppressed. If the driver circuit generates heat, when the detected temperature exceeds the third threshold value at the preceding stage of arriving at the second threshold value, duty control is performed, so that the detected temperature becomes hard to arrive at the second threshold value, and the processing of stopping the drive unit can be suppressed as much as possible.

According to a thirteenth aspect of the invention, in the second to eleventh aspects of the invention, if the temperature detected by the temperature detection unit exceeds a third threshold value set to a lower temperature than the second threshold value, the control unit controls the driver circuit to change drive speed of the drive unit.

According to the thirteenth aspect of the invention, in addition to the function of the second to eleventh aspects of invention, the third threshold value is set as a lower temperature than the second threshold value and when the temperature detected by the temperature detection unit exceeds the third threshold value, if the driver circuit is controlled so as to decrease the drive speed of the drive unit, heat generation of the driver circuit is suppressed. If the driver circuit generates heat, when the detected temperature exceeds the third threshold value at the preceding stage of arriving at the second threshold value, the drive speed of the drive unit is changed so as to suppress heat generation of the driver circuit, so that the detected temperature becomes hard to arrive at the second threshold value, and the processing of stopping the drive unit can be suppressed as much as possible.

According to a fourteenth aspect of the invention, there is provided a heat generation warning method used with a print apparatus comprising drive unit and a driver circuit for outputting a drive signal for driving the drive unit, wherein when internal temperature of the driver circuit exceeds a first threshold value, output of the drive signal is shutdown, wherein a temperature detection unit detects the internal temperature of the driver circuit, and a control unit controls the driver circuit to stop the drive unit based on determination information as to whether or not the temperature detected by the temperature detection unit exceeds a second threshold value set to a lower temperature than the first threshold value.

According to the fourteenth aspect of the invention, the internal temperature of the driver circuit is detected by the temperature detection unit. The control unit performs processing based on the determination information as to whether or not the temperature detected by the temperature detection unit exceeds the second threshold value; for example, if the detected temperature exceeds the second threshold value, the control unit controls the driver circuit to stop the drive unit. Therefore, if the driver circuit generates heat, the driver circuit is controlled and the drive unit is stopped before the internal temperature of the driver circuit exceeds the first threshold value and output of the drive unit is shut down, so that the driver circuit is protected from heat generation without using a method of shutting down output of the drive unit. Since the cooling method is a method of once stopping the drive unit, terminating each processing to execute cooling is avoided.

DETAILED DESCRIPTION OF PREFERRED EMBODIMENTS

Referring now to FIGS. 1 to 5, there is shown a preferred embodiment of an IC chip, a print apparatus, and a heat generation warning method embodying the invention.

Figure 2:
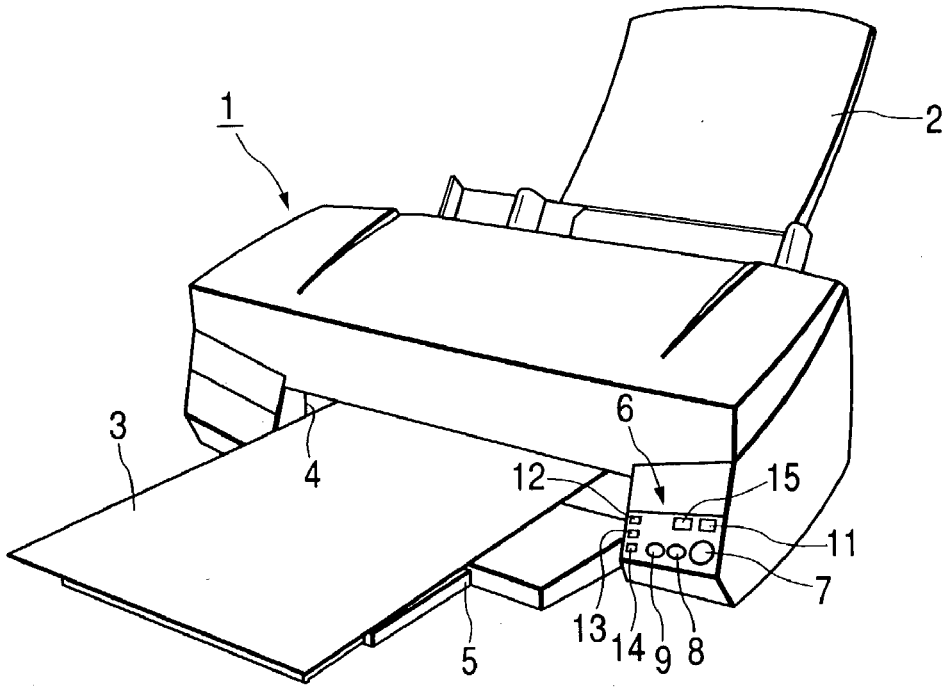
FIG. 2 is a perspective view to show the appearance of the printer.

FIG. 2 is a perspective view to show the appearance of a printer. An ink jet record apparatus as a print apparatus, which will be hereinafter referred to as printer, 1 performs print processing for record paper 3 set in a supply tray and places the record paper 3 completed in printing on a paper ejection tray 5 through a paper ejection port 4 for ejecting the paper. An operation panel 6 of the printer 1 is provided with switches 7 to 9. When the printer 1 is powered on, the power switch 7 is pressed. To manually feed or eject the record paper 3, the paper feed/ejection switch 8 is pressed. To manually perform the cleaning operation of forcibly sucking nozzles of a record head 10 (see FIG. 3), the ink maintenance switch 9 is pressed.

The operation panel 6 is provided with lamps 11 to 15 implemented as LEDs. When the power of the printer 1 is on, the power lamp 11 goes on. When no record paper 3 exists at the paper feed operation time, the paper check lamp 12 goes on; when a paper jam occurs, the paper check lamp 12 blinks. The black ink end lamp 13 or the color ink end lamp 14 blinks when the ink remaining amount of the corresponding color becomes small; the ink end lamp 13 or 14 goes on when the ink runs out. When the internal temperature of the printer 1 becomes a predetermined temperature and heat generation stop processing is executed, the heat generation warning lamp 15 goes on.

Figure 3:
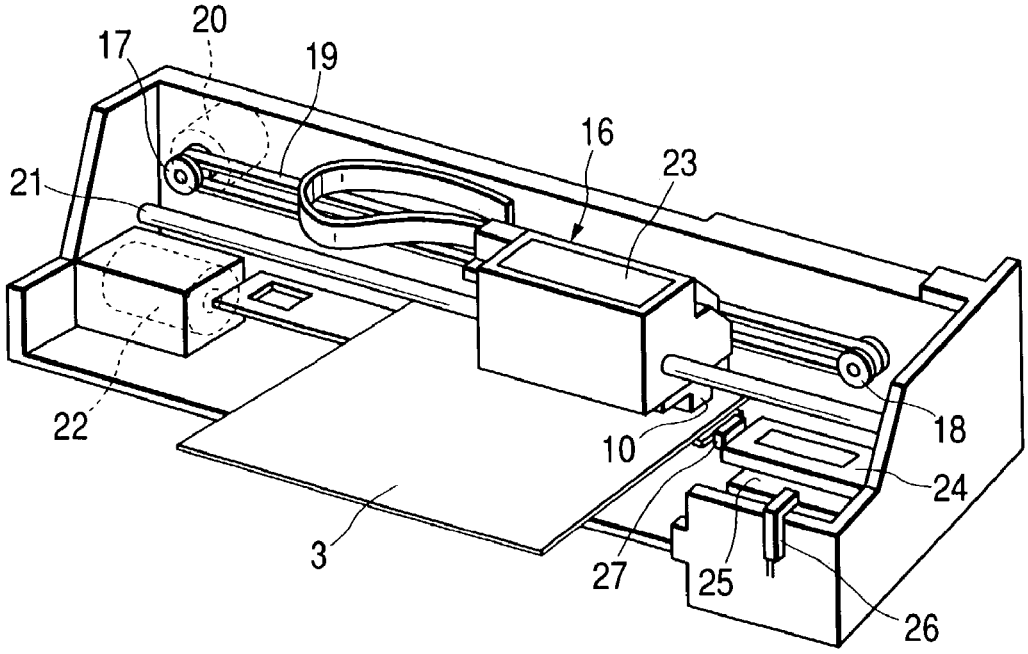
FIG. 3 is a perspective view to show the internal configuration of the printer.

FIG. 3 is a perspective view to show the internal configuration of the printer 1. The printer 1 comprises a carriage 16. The carriage 16 is attached to an endless timing belt 19 placed on a drive pulley 17 and a driven pulley 18. The timing belt 19 is driven by a carriage motor 20, whereby the carriage 19 is reciprocated in a main scanning direction with the carriage 19 guided by a rail 21. A paper feed motor 22 is installed in a lower corner of the printer 1. As the paper feed motor 22 is driven, the record paper 3 on the supply tray 2 is fed in a subscanning direction. The carriage motor 20 and the paper feed motor 22 correspond to a drive unit.

The record head 10 is disposed on the lower side of the carriage 16 opposed to the record paper 3, and ink cartridges for supplying ink to the record head 10 (in the embodiment, two types of black and color ink cartridges) are detachably mounted on the top of the carriage 16. The record head 10 is formed with a plurality of nozzles (not shown). When print processing is executed, ink is ejected through the nozzles toward the record paper 3 at a predetermined timing.

A cap 24 capable of sealing the nozzles of the record head 10 is disposed at a home position of the carriage 16 (in FIG. 3, right end). When the carriage 16 is at the home position, the cap 24 has a mechanism for sealing the record head 10 as the carriage 16 itself pushes up the cap 24. That is, when the carriage 16 is at the home position, automatically the record head 10 is capped.

A suction pump 25 for placing the internal space of the cap 24 under negative pressure when the cleaning operation is executed is connected to the cap 24 by a pump tube 26. The suction pump 25 is connected to the paper feed motor 22 by a gear mechanism (not shown) and uses the paper feed motor 22 as a drive source. A wiping member 27 made of an elastic plate of rubber, etc., is disposed between a print area of the record head 10 and the home position. When the record head 10 goes to the print area, the wiping member 27 wipes the surface of the record head 10.

Figure 1:
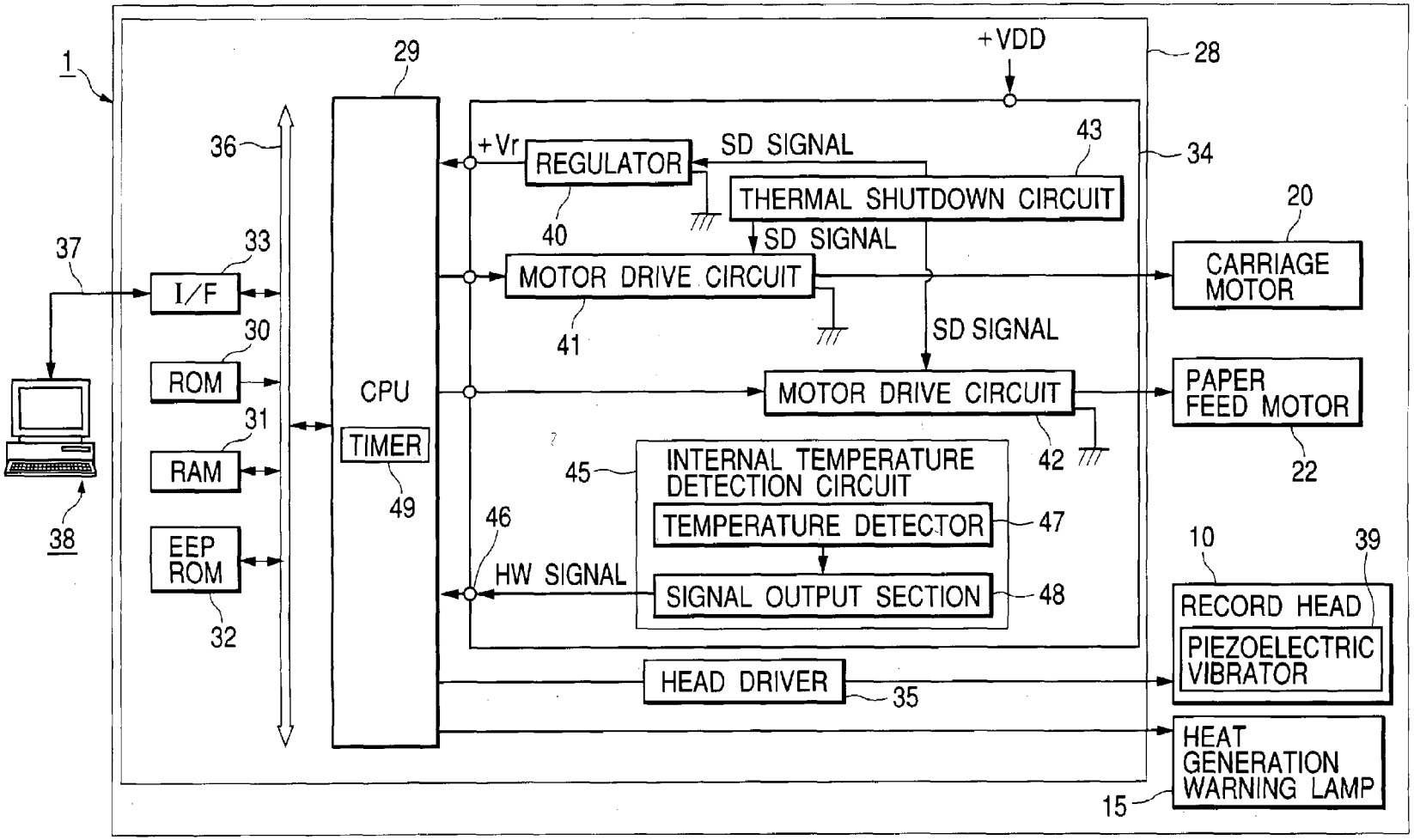
FIG. 1 is an electric block diagram of a printer in one embodiment of the invention.

FIG. 1 is an electric block diagram of the printer 1. The printer 1 comprises a control circuit board 28 on which a CPU 29, ROM 30, RAM 31, EEPROM 32, an I/F 33, a motor driver 34 as a driver circuit (IC chip), and a head driver 35 are mounted. The members 29 to 33 are connected to each other by a main bus 36. The printer 1 is connected to a host computer 38 by a cable 37 through the I/F 33, and executes print processing based on print data transmitted from the host computer 38. The CPU 29 executes various types of print operation such as print processing using the RAM 31 and the EEPROM 32 as memory areas according to a control program stored in the ROM 30. The CPU 29 corresponds to a control unit and a stop detection unit.

The motor driver 34 is implemented as a one-chip IC, and power supply voltage +VDD is supplied thereto. The motor driver 34 has input connected to the CPU 29 and output connected to the carriage motor 20 and the paper feed motor 22, and outputs a drive signal (motor signal) responsive to a control signal from the CPU 29 to the carriage motor 20 and the paper feed motor 22 for driving the motors 20 and 22. The head driver 35 has input connected to the CPU 29 and output connected to the record head 10, and outputs a drive signal (drive voltage) responsive to a control signal from the CPU 29 to the record head 10 for driving a piezoelectric vibrator 39 of the record head 10 for ejecting ink.

The motor driver 34 comprises a regulator 40 and two motor drive circuits 4l and 42. The regulator 40 outputs highly stable voltage +Vr, smoothed and regulated based on power supply voltage +VDD to the CPU 29 for use as the power supply to the CPU 29. Based on a control signal from the CPU 29, one motor drive circuit 41 drives the carriage motor 20 and the other motor drive circuit 42 drives the paper feed motor 22.

The motor driver 34 contains a thermal shutdown circuit 43. The thermal shutdown circuit 43 is implemented as a switch circuit for switching the connection state depending on the temperature. When internal temperature T exceeds threshold value Ta, the thermal shutdown circuit 43 outputs a shutdown signal (SD signal) to the regulator 40 and the motor drive circuits 41 and 42. At this time, the regulator 40 and the motor drive circuits 41 and 42 are disconnected from the power supply voltage +VDD, and the motor driver 34 is powered off. The carriage motor 20 and the paper feed motor 22 are stopped independently of the drive situation, and the print processing and paper feed operation are forcibly terminated. The power of the regulator 40 is also turned off.

The motor driver 34 contains an internal temperature detection circuit 45. The internal temperature detection circuit 45 is also implemented as a switch circuit for switching the connection state depending on the temperature, and is connected to a connection pin 46 extended from the package of the motor driver 34. The internal temperature detection circuit 45 has a temperature detector 47 as a temperature detection unit and a signal output section 48 as a signal output unit. The temperature detector 47 detects the internal temperature (detection temperature) T of the motor driver 34. When the internal temperature T exceeds threshold value Tb (<Ta), the signal output section 48 outputs a heat generation warning signal (HW signal) to the CPU 29 through the connection pin 46.

Figure 5:
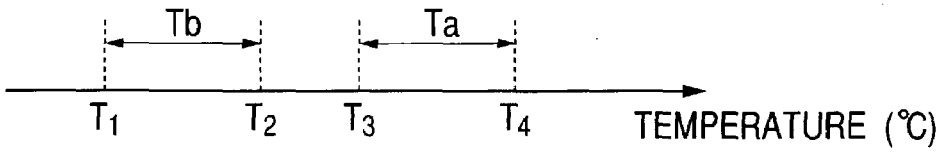
FIG. 5 is a schematic representation concerning threshold values Ta and Tb.

The threshold value Ta is set to a value in the range of T3 to T4 and the threshold value Tb is set to a value in the range of T1 to T2 (T1<T2<T3<T4) as shown in the relation in FIG. 5. That is, the threshold value Ta is a temperature value before the motor driver 34 is destroyed because of heat generation, and is set to a value in the range of T3 to T4 depending on the specifications. On the other hand, the threshold value Tb is a temperature value occurring in the motor driver 34 in a special pattern wherein the use condition of the motor deriver 34 is severe, namely, when print processing wherein the carriage 16 is often accelerated and decelerated or the paper feed amount is large is performed; the value is set in the range of T1 to T2 in response to the use condition.

During print processing or paper feed processing, when the carriage 16 is position at an end in the move direction, when the carriage motor 20 or the paper feed motor 22 stops, etc., the CPU 29 determines whether or not heat generation stop is to be applied. That is, the CPU 29 determines whether or not an HW signal is output from the internal temperature detection circuit 45 based on stop of the carriage motor 20 or the paper feed motor 22 as a trigger. If the internal temperature T of the motor driver 34 exceeds the threshold value Tb and the HW signal is output, the CPU 29 sets a heat generation warning flag F in the RAM 31 to ON and controls the motor driver 34 to stop both the carriage motor 20 or the paper feed motor 22 in a predetermined time. The CPU 29 turns on the heat generation warning lamp 15 during the heat generation stop mode.

In the heat generation stop mode, the CPU 29 monitors output of the HW signal at all times. When the internal temperature T of the motor driver 34 falls below the threshold value Tb and the HW signal is not output, the CPU 29 sets the heat generation warning flag F stored in the RAM 31 to OFF and sets a timer 49. When the timer 49 times out, the CPU 29 releases the heat generation stop and controls the motor driver 34 to restart driving the carriage motor 20 or the paper feed motor 22. At this time, the CPU 29 turns off the heat generation warning lamp 15 in addition to releasing the heat generation stop mode.

Figure 4:
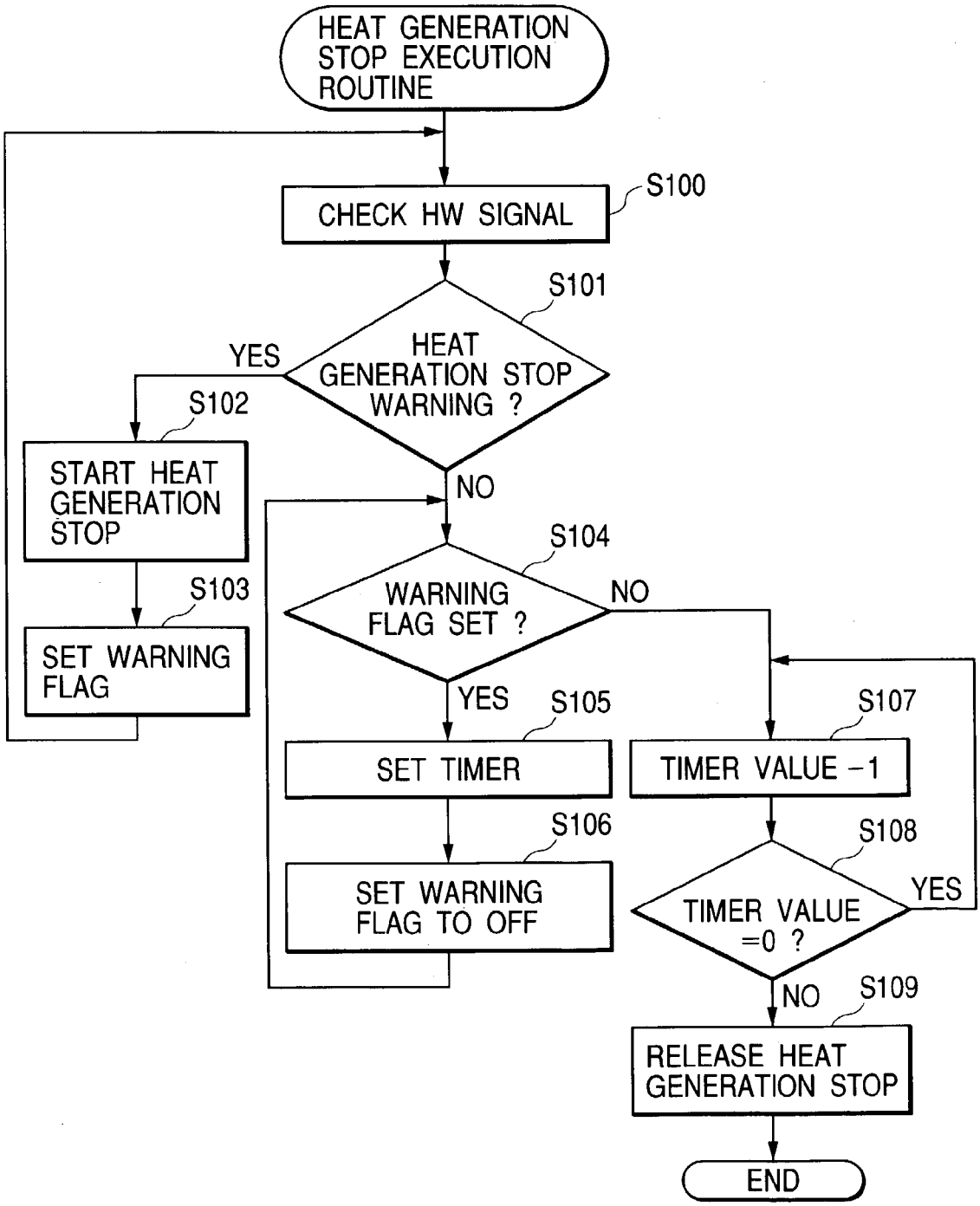
FIG. 4 is a flowchart to show processing executed in a heat generation stop mode.

Next, processing executed by the CPU 29 in the heat generation stop mode will be discussed with reference to a flow chart of FIG. 4. The processing is started using as a trigger, a signal output when at least either of the carriage motor 20 and the paper feed motor 22 stops, and is repeated every predetermined period (for example, several msec).

First, at step 100 (simply, S100), an HW signal is checked. That is, whether or not an HW signal is output from the internal temperature detection circuit 45 is checked.

At S101, whether or not heat generation warning is to be produced is determined. That is, when the internal temperature T of the motor driver 34 exceeds the threshold value Tb and an HW signal is input from the internal temperature detection circuit 45, control goes to S102. On the other hand, if the internal temperature T is the threshold value Tb or less and an HW signal is not input from the internal temperature detection circuit 45, control goes to S104.

At S102, heat generation stop is started. That is, the motor driver 34 is not driven to stop both the carriage motor 20 and the paper feed motor 22. At this time, the heat generation warning lamp 15 is also turned on.

At S103, the heat generation warning flag F is set in the RAM 31. After the heat generation warning flag F is set, control returns to S100 and if it is again determined at S101 that an HW signal is input, the heat generation stop node is maintained and the heat generation warning flag F is left set.

At S104, whether or not the heat generation warning flag F is set is determined, If the heat generation warning flag F is set, control goes to S105; otherwise, control goes to S107.

At S105, the timer 49 is set.

At S106, the heat generation warning flag F stored in the RAM 31 is set to OFF. After the heat generation warning flag F is set to OFF, control returns to S104.

At S107, the timer value of the timer 49 is decremented by one.

At S108, whether or not the timer value of the timer 49 becomes 0 is determined. That is, whether or not the timer 49 times out is determined, If the timer value is 0, control goes to S109; if the timer value is not 0, control returns to S107 and the step of decrementing the timer value by one is repeated.

At S109, the heat generation stop mode is released. That is, a control signal is sent to the motor driver 34 for releasing the stop state of the carriage motor 20 and the paper feed motor 22 and restarting driving the motors 20 and 22.

By the way, when print processing is executed in the printer 1, the motor driver 34 generates heat in response to driving of the carriage motor 20 and the paper feed motor 22, and the internal temperature T rises gradually. Particularly, when print processing wherein the carriage 16 is often accelerated and decelerated or paper feed processing of the record paper 3 is performed for a long time, heat generation becomes noticeable. In the embodiment, when the carriage motor 20 or the paper feed motor 22 stops, whether or not heat generation stop is to be applied is determined. If the internal temperature T exceeds the threshold value Tb and an HW signal is output from the motor driver 34, the heat generation stop processing is performed. Accordingly, print processing or paper feed processing is once stopped, the stop time or the motors 20 and 22 is increased, and the motor driver 34 is cooled The motor driver 34 is cooled until the timer 49 of the CPU. 49 times out after the internal temperature T becomes the threshold value Tb or less and the HW signal is not output from the motor driver 34. After the timer 49 times out, the carriage motor 20 and the paper feed motor 22 are again driven, and the print processing or paper feed processing once stopped is restarted.

Further, if the internal temperature T of the motor driver 34 rises excessively and exceeds the threshold value Ta higher than the threshold value Tb, thermal shutdown processing is executed. Then, output of the motor driver 34 is shut down, whereby the carriage motor 20 and the paper teed motor 22 are stopped for forcibly terminating the print processing and paper feed processing, and the motor driver 34 is protected from destruction caused by heat generation. The thermal shutdown processing is executed according to a different flow from that of the heat generation stop processing, and the CPU 29 does not directly see the thermal shut down processing and determines whether or not the thermal shutdown processing is performed from another motion.

Thus, in the thermal shutdown processing, as output of the motor driver 34 is shutdown, the print processing is forcibly terminated. Thus, although heat generation can be suppressed, the later print processing cannot be continued. However, if the internal temperature T of the motor driver 34 exceeds the threshold value Tb before the thermal shutdown function is operated, the motors 20 and 22 are stopped and heat generation stop for cooling the motor driver 34 is executed, so that the normal print processing can be continued while the motor driver 34 is protected from heat generation.

The embodiment can provide the following advantages:

(1) The threshold value Tb for starting heat generation stop is set as a temperature lower than the threshold value Ta for executing the thermal shutdown processing. When the internal temperature T of the motor driver 34 exceeds the threshold value Tb, the carriage motor 20 and the paper feed motor 22 are once stopped and the motor driver 34 is cooled as the heat generation stop processing. When heat generation of the motor driver 34 is released, the carriage motor 20 and the paper feed motor 22 are again driven, and the print processing and paper feed processing once stopped are restarted. Therefore, the motor driver 34 can be protected from heat generation and the cooling method is a method of once stopping the motors 20 and 22, so that the print processing and paper feed processing can be executed continuously.

(2) Since the heat generation stop processing is performed for cooling the motor driver 34 before the thermal shutdown processing is performed, the internal temperature T of the motor driver 34 becomes hard to exceed the threshold value Ta and the thermal shutdown processing can be made hard to occur. Accordingly, if the chip area of the motor driver 34 is lessened, the motor driver 34 is cooled by the heat generation stop processing before it is shut down, so that the thermal shutdown processing does not frequently occur and the chip area of the motor driver 34 can be miniaturized.

(3) When output of the HW signal stops from the motor driver 34, the timer 49 is set and the carriage motor 20 and the paper feed motor 22 are stopped for cooling the motor driver 34 until the timer 49 times out. Therefore, as compared with the case where driving the motors 20 and 22 is restarted when output of the HW signal stops, the cooling time when the motor driver 34 is cooled is prolonged and the motor driver 34 can be cooled sufficiently.

(4) If the heat generation stop processing is executed and the carriage 16 is stopped at an intermediate point in the move path while one-pass printing is being performed, if the printing is restarted at the point, print unevenness occurs. In the embodiment, however, when the carriage 16 is positioned at the end in the move direction and the carriage motor 20 stops, whether or not the heat generation stop processing is to be executed is determined and if the heat generation stop processing is to be executed, the stop time at the position is taken long. Thus, the carriage does not stop during one-pass printing.

(5) Since the printer 1 is provided with the heat generation warning lamp 15 and the heat generation warning lamp 15 is lighted during execution of heat generation stop, the user can be notified that heat generation stop is executed.

(6) In the motor driver 34 containing the regulator 40 for supplying power to the CPU 29, it is not preferred that the thermal shutdown processing is executed for turning off the power of the motor driver 34. However, since the heat generation stop processing is performed for cooling the motor driver 34 before the thermal shutdown processing is performed, the thermal shutdown processing becomes hard to occur, and various problems occurring when the motor driver 34 containing the regulator is shut down can be solved. When the heat generation stop processing is performed, the regulator 40 is cooled and thus can be protected from heat generation.

(7) Since the motor driver 34 drives the carriage motor 20 and the paper feed motor 22, one chip can drive a plurality of motors.

The invention is not limited to the specific embodiment and can be modified to the following:

Modification 1

The invention is not limited to the configuration wherein the internal temperature detection circuit 45 implemented as a switch circuit is used and the CPU 29 performs the heat generation stop processing based on the HW signal output from the internal temperature detection circuit 45. For example, the motor driver 34 is provided with a temperature sensor as a temperature detection unit and the CPU 29 monitors the detection value from the temperature sensor and if the internal temperature T of the motor driver 34 found based on the detection value exceeds the threshold value Tb, the heat generation stop processing may be executed.

Modification 2

The determination as to whether or not the internal temperature T of the motor driver 34 exceeds the threshold value Tb is not limited to the determination executed based on stop of the carriage motor 20 or the paper feed motor 22 as a trigger. For example, the CPU 29 monitors the HW signal from the internal temperature detection circuit 45 at all times and when the internal temperature T exceeds the threshold value Tb, the carriage motor 20 and the paper feed motor 22 may be stopped immediately. In this case, heat generation of the motor driver 34 caused by driving the carriage motor 20 and the paper feed motor 22 can be minimized.

Modification 3

As a method of stopping the paper feed motor 22 in the heat generation stop processing, the paper feed motor 22 may be stopped immediately. For example, when the HW signal is input from the internal temperature detection circuit 45, if paper feed processing is executed, the CPU 29 calculates the remaining paper feed time and if the paper feed time exceeds a predetermined threshold value, the CPU 29 immediately stops the paper feed motor 22. In this case, heat generation of the motor driver 34 caused by driving the paper feed motor 22 and the paper feed motor 22 can be minimized.

Modification 4

Figure 6:
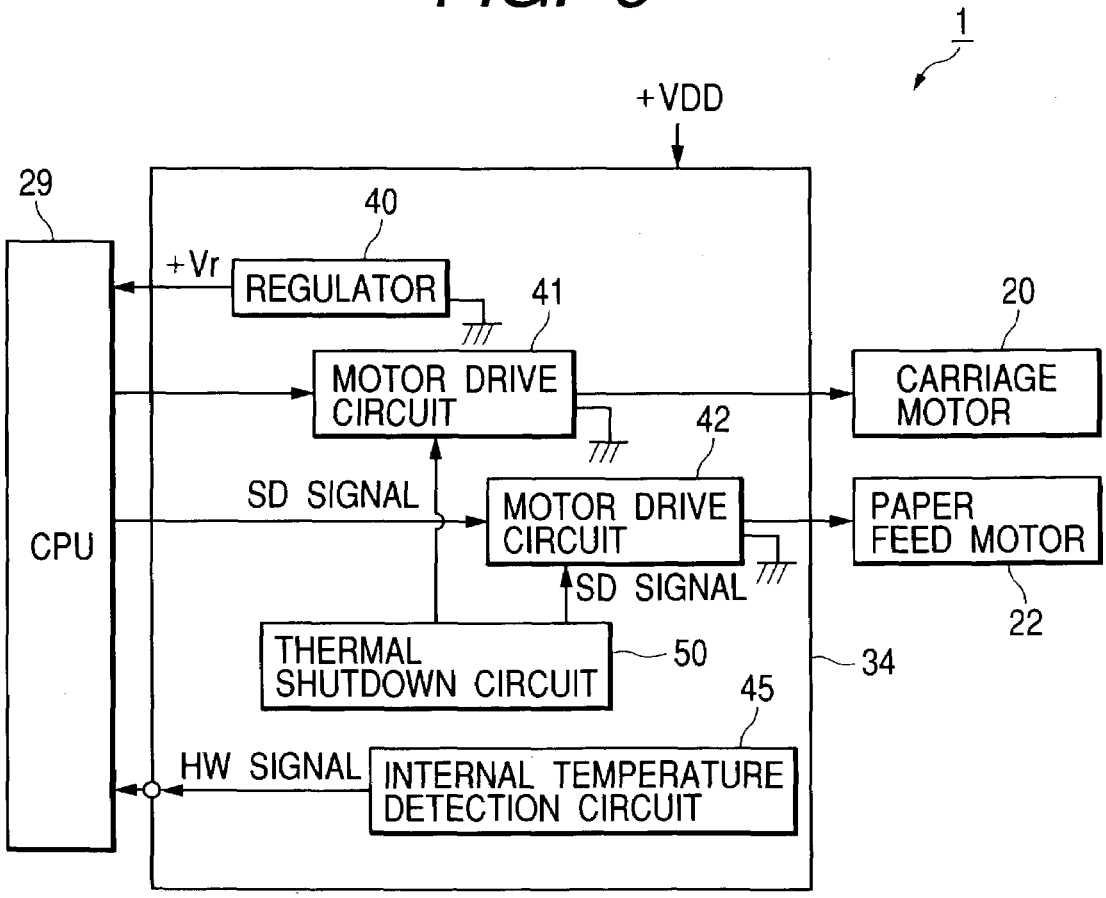
FIG. 6 is a schematic block diagram of a printer in another example.

The thermal shutdown circuit 43 is not limited to the circuit for turning off also the power of the regulator 40. For example, a thermal shutdown circuit 50 for turning off the power of only the motor drive circuits 41 and 42 may be provided, as shown in FIG. 6.

Modification 5

The invention is not limited to the mode wherein when output of the HW signal from the internal temperature detection circuit 45 stops, the timer 49 is set and when the timer 9 times out, driving the carriage motor 20 and the paper feed motor 22 is restarted. That is, when output of the HW signal from the internal temperature detection circuit 45 stops, driving the motors 20 and 22 may be restarted.

Modification 6

The heat generation stop processing is not limited to processing where in the heat generation warning lamp 15 is lighted, thereby notifying the user that the heat generation stop processing is being executed, and may be a configuration wherein the user is not notified that the heat generation stop processing is being executed. The method is not limited to use of the heat generation warning lamp 15 to provide visual information for the user; for example, a loudspeaker, etc., may be used to provide auditory information for the user when the user is notified that the heat generation stop processing is being executed.

Modification 7

The regulator 40 contained in the motor driver 34 may or may not be shut down at the thermal shutdown processing time. The motor driver 34 need not necessarily contain the regulator 40; the regulator may be omitted.

Modification 8

The motor driver 34 is not limited to that for driving both the carriage motor 20 and the paper feed motor 22; one may drive the carriage motor 20 and one may drive the paper feed motor 22. One motor driver 34 may drive three or more motors; it may drive any other motor installed in the printer 1, such as a paper feed motor for driving a paper feed roller independently, in addition to the carriage motor 20 and the paper feed motor 22.

Modification 9

The driver circuit is not limited to the motor driver 34 for driving motors of the carriage motor 20, the paper feed motor 22, etc.,; for example, it may be any other drive circuit such as the head driver 35. At this time, the piezoelectric vibrator 39 corresponds to a drive unit.

Modification 10

Using the motor driver 34, whether or not heat generation stop is to be applied only when the carriage motor 20 stops may be determined. In constant, whether or not heat generation stop is to be applied only when the paper feed motor 22 stops may be determined.

Modification 11

The heat generation suppression processing of the motor driver 34 is not limited to the method of once stopping the carriage motor 20 and the paper feed motor 22 and prolonging the stop time (heat generation stop processing). For example, the following method may be used: Threshold value Tc (third threshold value) is set as a temperature lower than the threshold value Tb and when the internal temperature T exceeds the threshold value Tc, duty control of the motor driver 34 is performed for suppressing output of the carriage motor 20 and the paper feed motor 22. The duty control refers to control of changing the duty ratio of voltage (current) applied to the motor 20, 22 and dropping output of the motor 20, 22 by a predetermined value.

In this case, if the motor driver 34 generates heat, the operating condition of the motor driver 34 is suppressed under the duty control at the preceding stage of the internal temperature T going to Tb and accordingly heat generation of the motor driver 34 can be suppressed. As a result, the frequency at which the internal temperature T reaches the threshold value Tb lessens and the occurrence frequency of the heat generation stop processing can be lessened. At this time, if the internal. temperature T continues to exceed the threshold value Tc for a predetermined time, the duty ratio may be further lowered for suppressing the temperature rise.

Modification 12

The heat generation suppression processing under the duty control may be applied to the head driver 35 rather than the motor driver 34, and duty control of the head driver 35 may be performed, thereby lowering the duty ratio of voltage applied to the piezoelectric vibrator 39.

Modification 13

To set the threshold value Tc and perform duty control, threshold value Td (fourth threshold value) may be set between the threshold values Tb and Tc and such processing of placing the internal temperature T between the threshold values Tc and Td may be performed. That is, if the internal temperature T exceeds the threshold value Tc, the duty control is started and when the temperature rise further continues and the internal temperature T exceeds the threshold value Td, the duty ratio is lowered and the cooling degree of the motor driver 34 is raised. In this case, the internal temperature T becomes still harder to reach the threshold value Tb and the occurrence frequency of the heat generation stop processing can be still more suppressed.

Modification 14

To perform the duty control at the preceding stage of performing the heat generation stop processing, the number of threshold values is not limited to one (use of the threshold value Tc) or two (use of the threshold values Tc and Td). That is, the number of threshold values to perform the duty control may be three or more and the duty ratio may be set for each threshold value area for effectively suppressing heat generation of the motor driver 34.

Modification 15

The heat generation suppression processing of the motor driver 34 is not limited to the heat generation stop processing or the duty control. For example, the following method may be used: Threshold value Tc (third threshold value) is set as a temperature lower than the threshold value Tb and when the internal temperature T exceeds the threshold value Tc, the motor driver 34 is controlled for suppressing the drive speed of the carriage motor 20 and the paper feed motor 22. In this case, if the motor driver 34 generates heat, the drive speed of the motor 20, 22 is lowered at the preceding stage of the internal temperature T going to Tb, whereby the operating state of the motor driver 34 is suppressed and accordingly heat generation of the motor driver 34 can be suppressed. Further, as a result, the frequency at which the internal temperature T reaches the threshold value Tb lessens and the occurrence frequency of the heat generation stop processing can be lessened.

Modification 16

The print apparatus is not limited to the ink jet printer 1; for example, it may be any other type of printer such as a color printer, a laser beam printer, or a dot impact printer, and heat generation stop processing of the motor driver installed in any of the printers may be performed. The heat generation stop processing may be adopted for the motor driver for driving a motor installed in a scanner. The heat generation stop processing in the embodiment maybe adopted not only for printers, scanners, etc., but also for any other OA machine.

The technical ideas that can be understood from the embodiment and the modifications as well as the advantages thereof is as follows:

Technical Idea 1

A regulator is provided for supplying stable power to a predetermined circuit other than the IC chip. In this case, stable power can be supplied to the predetermined circuit from the IC chip. ps Technical Idea 2

The second threshold value is set to a temperature value occurring in the driver circuit when the drive unit is driven under severe use condition.

Technical Idea 3

If the temperature detected by the temperature detection unit exceeds the second threshold value, the control unit controls the driver circuit to stop the drive unit.

Technical Idea 4

When the driver circuit is cooled as the drive unit is stopped and the detected temperature becomes equal to or less than the second threshold value, the control unit restarts driving the drive unit so as to continue processing at the stop point in time.

Technical Idea 5

In the technical idea 4, if the driver circuit is cooled as the drive unit is stopped and the detected temperature becomes equal to or less than the second threshold value, the control unit maintains the drive unit in the stop state for a predetermined time before restarting to drive the drive unit.

Technical Idea 6

In the technical ideas 4 and 5, the print apparatus comprises a stop detection unit for determining whether or not the drive unit stops, wherein if the stop detection unit detects the drive unit stopping, the control unit determines whether or not the detected temperature exceeds the second threshold value.

Technical Idea 7

In the technical ideas 4 to 5, the drive unit is a carriage motor for driving a carriage or a paper feed motor for moving paper, and when the carriage motor or the paper feed motor stops, the control unit determines whether or not the detected temperature exceeds the second threshold value.

Technical Idea 8

In the technical ideas 4 to 7, the print apparatus comprises a notification unit, when the temperature detected by the temperature detection unit exceeds the second threshold value and the control unit stops the drive unit, for informing the user of the fact. In this case, similar advantages to those in claim 8 can be provided.

Technical Idea 9

In the technical ideas 4 to 8, the driver circuit is one IC chip comprising a temperature detection unit for detecting internal temperature of the IC chip, and a signal output unit for outputting a signal to stop the drive unit as a determination information if the temperature detected by the temperature detection unit exceeds the second threshold value, and the control unit controls the driver circuit to stop the drive unit based on the signal output from the IC chip.

Technical Idea 10

In the technical ideas 4 to 9, if the temperature detected by the temperature detection unit exceeds a third threshold value set to a lower temperature than the second threshold value, the control unit performs duty control of the driver circuit.

Technical Idea 11

In the technical philosophy 4 to 9, if the temperature detected by the temperature detection unit exceeds a third threshold value set to a lower temperature than the second threshold value, the control unit controls the driver circuit to change drive speed of the drive unit.

Technical Idea 12

If the temperature detected by the temperature detection unit exceeds the second threshold value, the control unit controls the driver circuit to stop the drive unit.

As described above in detail, according to the invention, the driver circuit can be protected from heat generation and in addition, if the driver circuit is protected from heat generation, predetermined processing operation can be continuously executed.

What is claimed is:

1. An apparatus:

a motor driver for outputting a drive signal responsive to a control signal for driving a motor, wherein when an internal temperature of the motor driver exceeds a first threshold value, output of the drive signal is shut down, the motor driver comprising:

a temperature detection unit for detecting the internal temperature of the motor driver;

a signal output unit for outputting a warning signal when the internal temperature detected by the temperature detection unit exceeds a second threshold value set to a lower temperature than the first threshold value; and a control unit for controlling the motor driver connected thereto by using the control signal and for detecting a stop of the motor in a normal operation mode and the warning signal, wherein the control unit determines whether or not to activate a heat generation stop mode based on the warning signal when detecting the stop of the motor in the normal operation mode.

2. The apparatus according to claim 1, wherein when the motor driver is cooled as the motor is stopped and the detected internal temperature becomes equal to or less than the second threshold value, the control unit restarts driving the motor so as to continue processing at the stop point in time.

3. The apparatus according to claim 1, wherein if the motor driver is cooled as the motor is stopped and the detected temperature becomes equal to or less than the second threshold value, the control unit maintains the motor in the state of stopping for a predetermined time before restarting to drive the motor.

4. The apparatus according to claim 1, further comprising a stop detection unit for determining whether or not the motor stops, wherein if the stop detection unit detects the motor stopping, the control unit determines whether or not the detected internal temperature exceeds the second threshold value.

5. The apparatus according to claim 4, wherein the motor is a carriage motor for driving a carriage or a paper feed motor for moving paper, and when the carriage motor or the paper feed motor is stopped, the control unit determines whether or not the detected internal temperature exceeds the second threshold value.

6. The apparatus according to claim 1, wherein when the detected internal temperature exceeds the second threshold value, the control unit immediately controls the motor driver to stop the motor.

7. The apparatus according to claim 1 further comprising a notification unit for informing a user when the internal temperature detected by the temperature detection unit exceeds the second threshold value and the control unit stops the motor.

8. The apparatus according to claim 1, wherein the motor driver comprises a regulator for supplying stable power to a predetermined circuit other than the motor driver contained in the apparatus.

9. The apparatus according to claim 1, wherein the motor driver can drive a plurality of motors.

10. The apparatus according to claim 1, wherein when the internal temperature detected by the temperature detection unit exceeds a third threshold value set to a lower temperature than the second threshold value, the control unit performs duty control of the motor driver.

11. The apparatus according to claim 1, wherein when the internal temperature detected by the temperature detection unit exceeds a third threshold value set to a lower temperature than the second threshold value, the control unit controls the motor driver to change a drive speed of the motor.

12. The apparatus according to claim 1, wherein when the heat generation stop mode is activated, the motor is stopped in a predetermined time period.

13. A heat generation warning method used with an apparatus comprising a motor and a motor driver for outputting a drive signal responsive to a control signal for driving the motor, wherein when an internal temperature of the motor driver exceeds a first threshold value, output of the drive signal is shut down, the heat generation warning method comprising:

detecting the internal temperature of the motor driver by;

outputting a warning signal when the internal temperature exceeds a second threshold value set to a lower temperature than the first threshold value;

controlling the motor driver using the control signal;

detecting a stop of the motor in a normal operation mode;

detecting the warning signal; and determining whether or not to activate a heat generation stop mode based on the warning signal when detecting the stop of the motor in the normal operation mode.

14. The heat generation warning method according to claim 13, wherein when the heat generation stop mode is activated, the motor is stopped in a predetermined time period.

* * * * *